United States Patent [19]

Rembold

[11] 4,451,218

[45] May 29, 1984

[54] VANE-PISTON PUMP

[75] Inventor: Helmut Rembold, Stuttgart, Fed. Rep. of Germany

[73] Assignee: Robert Bosch GmbH, Stuttgart, Fed. Rep. of Germany

[21] Appl. No.: 397,743

[22] Filed: Jul. 13, 1982

[30] Foreign Application Priority Data

Sep. 11, 1981 [DE] Fed. Rep. of Germany ..... 3135978

[51] Int. Cl.[3] ..... F04C 2/00; F04C 15/00; F04C 27/00

[52] U.S. Cl. ..... 418/137; 418/241

[58] Field of Search ..... 418/137, 241, 136

[56] References Cited

U.S. PATENT DOCUMENTS 2,625,112 1/1953 Stubau ..... 418/137

3,485,179 12/1969 Dawes ..... 418/137

*Primary Examiner*—John J. Vrablik

*Assistant Examiner*—John J. McGlew, Jr.

*Attorney, Agent, or Firm*—Edwin E. Greigg

[57] ABSTRACT

A vane-piston pump having a rotor supported eccentrically in a pump housing. The rotor is provided with slits for the passage through it of the vanes, and sealing strips are disposed at either side of the slits. The vanes slide along these sealing strips. Each sealing strip is subjected to the force of its own spring, and under the force of this spring, each sealing strip is pressed against the vanes.

In this manner the spring forces can be kept smaller, so that friction is reduced. The vane-piston pump is preferably used in motor vehicles for generating compressed air in order to operate exhaust-gas treatment apparatus.

5 Claims, 4 Drawing Figures

VANE-PISTON PUMP

BACKGROUND OF THE INVENTION

The invention is based on a vane-piston pump having a rotor body which is supported eccentrically within a pump housing and also includes slits for the passage therethrough of the vanes. The rotor body moreover has spring urged sealing strips which provide for sealing engagement on opposite sides of the vanes of the pump. A vane-piston pump of this type is known (German Offenlegungsschrift No. 1 553 063).

In a vane-piston pump of this known type, the vanes are supported on a bolt such that they are rotatable about a stroke-ring center point. Coupled movement is effected via a rotor disposed eccentrically relative to the stroke ring. Upon rotation, the vanes execute a tilting movement relative to the rotor. Sealing between the vanes and the rotor is effected with linear contact by one sealing strip being arranged to engage each side of the vane. Accordingly, two sealing strips per vane are required, and of these the rearward strip is firmly pressed into the rotor. The forward sealing strip is pressed against the vane via a leaf spring. The spring force in this instance must be dimensioned such that, at maximum drive rpm after top dead center has been exceeded, and given the retardation which than occurs and the resultant force of the voluminous vanes, the vanes will not lift up from the fixed sealing strips. In large-volume pumps, because of the great inertial moment of the vanes, this necessitates strong forces acting upon the vanes. The result is then that at low rpm, the friction is relatively great.

OBJECT AND SUMMARY OF THE INVENTION

The vane-piston pump revealed hereinafter has the advantage over the prior art that an active contact of both sealing strips resting on the vane is attained. The spring force exerted upon the sealing strips must be dimensioned such that the sealing strip merely follows the vane sufficiently rapidly when the vane tilts, or in other words that the sealing strip will not lift away from the vane at that time. Because the mass of the sealing strip is quite small in comparison with the total effective mass forces, the spring force can be dimensioned smaller as well, which has the advantage that friction is reduced.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
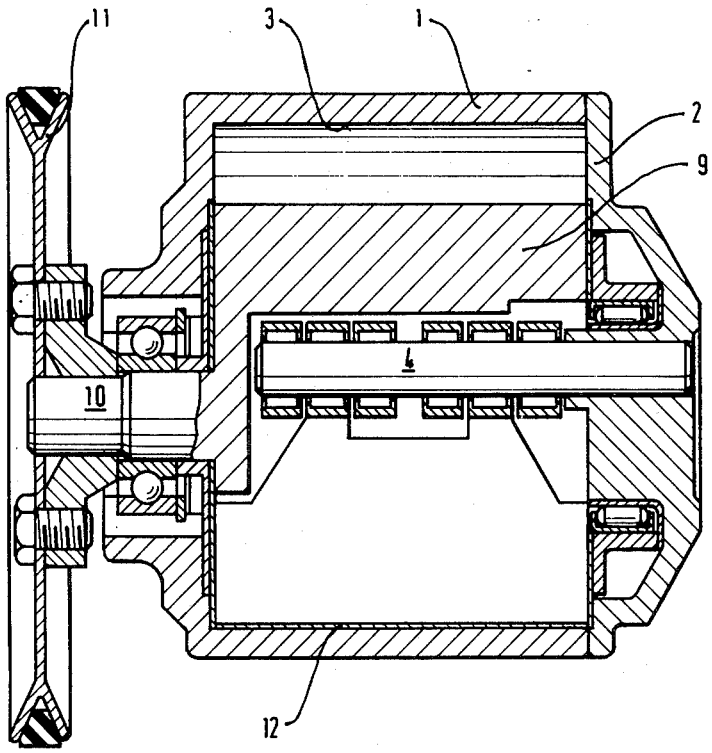
FIG. 1 is a cross sectional view of a vane-cell pump as seen from the side.

A vane-piston pump has a pump housing 1, which is closed at the side by a cover plate 2. An inner wall 3 of the pump housing 1 has a substantially circular cross section. A shaft means 4 secured in the cover plate 2 carries three vanes 6, 7 and 8.

A rotor 9 is disposed eccentrically relative to the shaft 4 and is driven from outside the pump via a shaft 10 and a pulley 11. A sealing strip 12, along which the rotor 9 slides, is disposed at the bottom of the pump housing 1.

Figure 2:
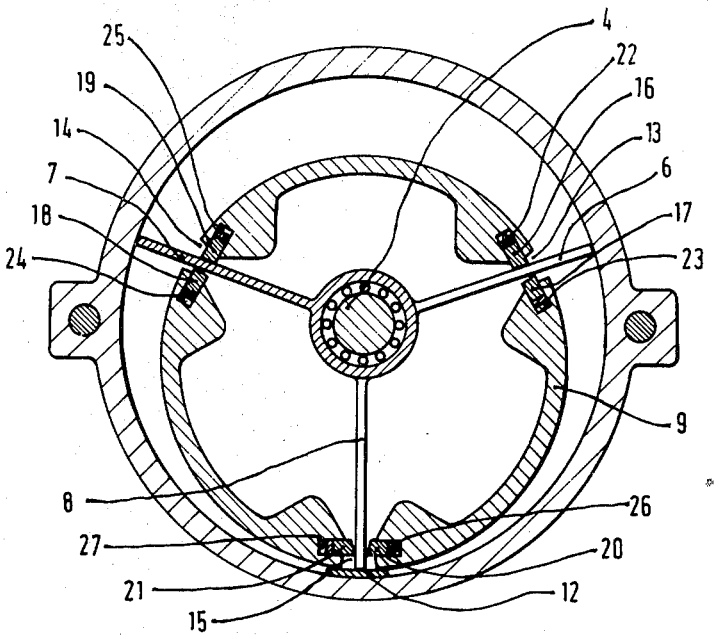
FIG. 2 is a longitudinal cross section through the pump.

As may be seen in FIG. 2, the rotor 9 has slits 13, 14 and 15 at the points where the three vanes 6, 7 and 8 pass through the wall thereof. One pair of sealing strips 16/17, 18/19 and 20/21 is provided in each slit 13, 14 and 15. One sealing strip is inserted partway into each of respective rotor grooves 22, 23, 24, 25, 26 and 27.

Figure 3:
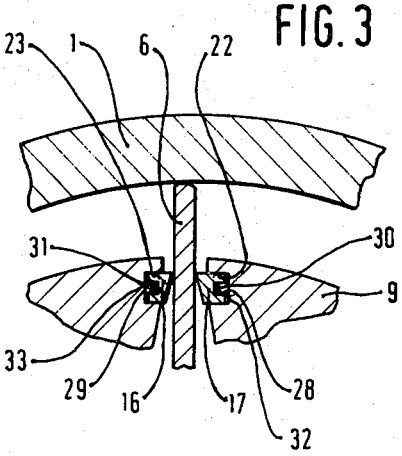
FIG. 3 shows a fragmentary view of a passageway for a vane through the rotor.

The appearance of this structure in detail is best understood from FIG. 3. There, one vane 6 and one pair of sealing strips 16/17 are shown, and the corresponding rotor grooves 22 and 23 are also shown. Each sealing strip 16 and 17 has at its rear a groove 28 and 29, respectively, into which respective leaf springs 30 and 31 are inlaid such as to protrude somewhat from the groove.

The leaf springs 30 and 31 are supported on the groove bottoms 32 and 33, respectively, of the rotor grooves 22 and 23.

Figure 4:
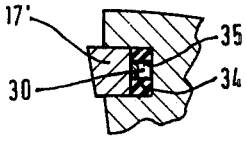
FIG. 4 shows a fragmentary view of a modification of a detail of FIG. 3.

As shown in FIG. 4, it is also possible for the leaf springs 30 and 31 to be augmented by an elastic cushion 34. Then the leaf spring 30 will preferably not be inserted into the rear of one sealing strip 17' but rather into a recess 35 of the elastic cushion 34.

MODE OF OPERATION

When the rotor 9 is driven, the vanes 6, 7 and 8 move in coupled fashion with it, and the pump begins to operate. Each spring pressing the sealing strip against the vanes is dimensioned such that each sealing strip is movable on its own and remains in contact with the vane. By means of this "active" contact of the sealing strips on the vanes thus provided, the spring force exerted on the sealing strips needs to be only great enough that each sealing strip follows the vane sufficiently rapidly, without lifting up from it, when the vane tilts. Because of the substantially smaller mass of a sealing strip in comparison with that of the vane, it is thus possible for the spring force to be smaller in dimension, so that friction and wear are decreased.

The variant embodiment of FIG. 4 has the advantage that interfering noises associated with the tilting of the vane are avoided. The elastic material of the cushion 34 damps the shocks which do occur.

Finally, it may be advantageous for the springs of one pair of sealing strips to be selected in a different strength, in order to do justice to the given condition that the vane mass force is in fact exerted in both the positive and negative directions, but the gas force of the compressed air thus generated is exerted in only one direction, resulting in different acceleration conditions for the two sealing strips of one pair of sealing strips.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A vane-piston pump comprising a plurality of vanes within a pump housing, a rotor supported eccentrically within said pump housing and said vanes, said rotor having oppositely disposed slitted zones for the passage therethrough of said vanes, sealing strips in said slitted zones along which said vanes slide each said slitted zone is provided with an elastic cushion and a spring means which produces a spring force against said elastic cushion within said slitted zones which augments said spring means to produce a force on each of said sealing strips.

2. A vane-piston pump as defined by claim 1, in which said spring means are each embodied by one strip-like leaf spring.

3. A vane-piston pump as defined in claim 1 in which said elastic cushion is provided with a recess and said spring means is disposed in said recess.

4. A vane-piston pump as defined by claim 1 in which in oppositely disposed slitted zones, said spring means have different spring forces.

5. A vane-piston pump as defined in claim 3 in which in oppositely disposed slitted zones, said spring means have different spring forces.

* * * * *